US009327814B2

(12) United States Patent
Packer

(10) Patent No.: US 9,327,814 B2
(45) Date of Patent: May 3, 2016

(54) ADJUSTABLE PADDLE

(75) Inventor: Rick Packer, Whitby (CA)

(73) Assignee: DYNAPLAS LTD., Toronto (CA)

( * ) Notice: Subject to any disclaimer, the term of this patent is extended or adjusted under 35 U.S.C. 154(b) by 929 days.

(21) Appl. No.: 13/566,226

(22) Filed: Aug. 3, 2012

(65) Prior Publication Data

US 2014/0037457 A1 Feb. 6, 2014

(51) Int. Cl.
*F16B 7/04* (2006.01)
*B63H 16/04* (2006.01)

(52) U.S. Cl.
CPC ..... *B63H 16/04* (2013.01); *Y10T 403/602* (2015.01)

(58) Field of Classification Search
CPC .... B63H 16/04; B63H 16/043; F16B 7/0413; F16B 7/00; F16B 7/0433; F16B 7/10; B63B 35/71
See application file for complete search history.

(56) References Cited

U.S. PATENT DOCUMENTS

| | | | | |
|---|---|---|---|---|
| 4,820,216 | A * | 4/1989 | Masters | 440/101 |
| 6,022,255 | A * | 2/2000 | Lukanovich | 440/101 |
| 7,367,858 | B2 * | 5/2008 | Matuska et al. | 440/101 |
| 8,167,669 | B1 * | 5/2012 | Xie et al. | 440/102 |
| 2004/0023570 | A1 * | 2/2004 | Bridge et al. | 440/101 |
| 2007/0184729 | A1 * | 8/2007 | Kicker | 440/102 |
| 2012/0028519 | A1 * | 2/2012 | Rechner et al. | 440/103 |
| 2013/0101418 | A1 * | 4/2013 | McClain | 416/71 |
| 2013/0266442 | A1 * | 10/2013 | Lass | 416/1 |
| 2014/0248075 | A1 * | 9/2014 | Lee | 403/109.1 |

* cited by examiner

*Primary Examiner* — Dwayne J White
*Assistant Examiner* — Joshua R Beebe
(74) *Attorney, Agent, or Firm* — Dorf & Nelson LLP; Scott D. Locke, Esq.

(57) ABSTRACT

A joint is provided for a double bladed paddle which allows for the angle between the blades to be adjusted relative to one another. The joint is formed from joining a female body recessed into a first shaft with a male body extending from a second shaft. The female body encloses a spring mechanism abutted by teeth of a crown with receiving grooves. The male body has protuberances which fit within the receiving grooves leading to the spring mechanism which when pushed in by the male body allows the protuberances to move past the receiving grooves and rotate to slot into the pockets formed between the teeth of the crown.

14 Claims, 8 Drawing Sheets

ADJUSTABLE PADDLE

FIELD OF THE INVENTION

The present invention relates to a paddle and more specifically to a double bladed boat paddle with adjustable blade angles.

BACKGROUND OF THE INVENTION

Paddles, particularly kayak paddles, are available in different lengths, blade configurations and angle of the blades given that there are differences in the user's size, skill and preferences as well as water conditions. It is particularly advantageous to have a paddle that is easily adjustable in relative blade angle.

Canadian Patent 2,280,701 discloses a paddle that is adjustable in length using similar technology as found in a conventional pool skimmer, namely a simple compression collar design. In this design, a slit collar is in a fixed position on a first shaft end and the second shaft is slidably engaged within the first. The slit collar also has male threads and a sliding compression collar (movable, with female threads) that can be rotatably engaged onto the fixed collar. When engaged, the outer collar squeezes the inner collar and collapses onto the inner sliding shaft fixing it into position (length and angle).

U.S. Pat. No. 4,820,216 discloses a double bladed paddle with an adjustable joint of three concentric shafts fixed together by a compression lock for "infinitely adjusting the angle at which the blades may be set relative to each other".

Neither of these designs provide for finding the exact blade angle adjustment but rather offer an 'infinite' scale of adjustments.

U.S. patent application Ser. No. 12/846,713 (publication number 2012/0028519) discloses another paddle with a connecting joint joining shafts which have blades at their ends. The connecting joint provides for adjusting the angle of the blades but includes an optional retaining clip so that selection of the blade angle can occur without disassembly of the shafts of the paddle. Another design for adjusting and holding the blade angle uses a locking cam collar which is problematic since it is difficult to repeat an adjustment precisely and the lever is susceptible to catching on the users clothing particularly bulkier clothing used in colder weather.

U.S. Pat. No. 6,881,111 discloses a paddle with an adjustable blade angle using a push button through a hole which is pushed down to release the setting. Adjusting blade angles using a simple spring dome button that locks the two shafts together generally only provides a couple fixed angles since a hole is needed for each discrete angle. This does not provide an adequate range of adjustments and is very susceptible to failure in use (particularly fractures around the hole where the button pops into).

Other paddles with adjustable blade angles require a tool, such as an Allen key (hex key) to make adjustments with the obvious disadvantage of needing to have the tool and the risk of losing the tool, particularly into the water.

It would be helpful to have a paddle that is easily adjusted in the angle of the blades with discrete blade angle selections to enable the user to pick the desired angle without trial and error, and additionally with minimal components to adjust. The present invention provides for a very strong boat paddle with numerous locking positions for various blade angles which is not susceptible to corrosion, has no push buttons or tools, is easy to use and adjustable by a user who is already paddling in the water, and additionally can be separated into two parts for each of transport and storage.

SUMMARY OF THE INVENTION

Set out a brief description of the invention, typically a "plain English" version of the independent claims of an application.

DETAILED DESCRIPTION OF THE FIGURES

Figure 1:
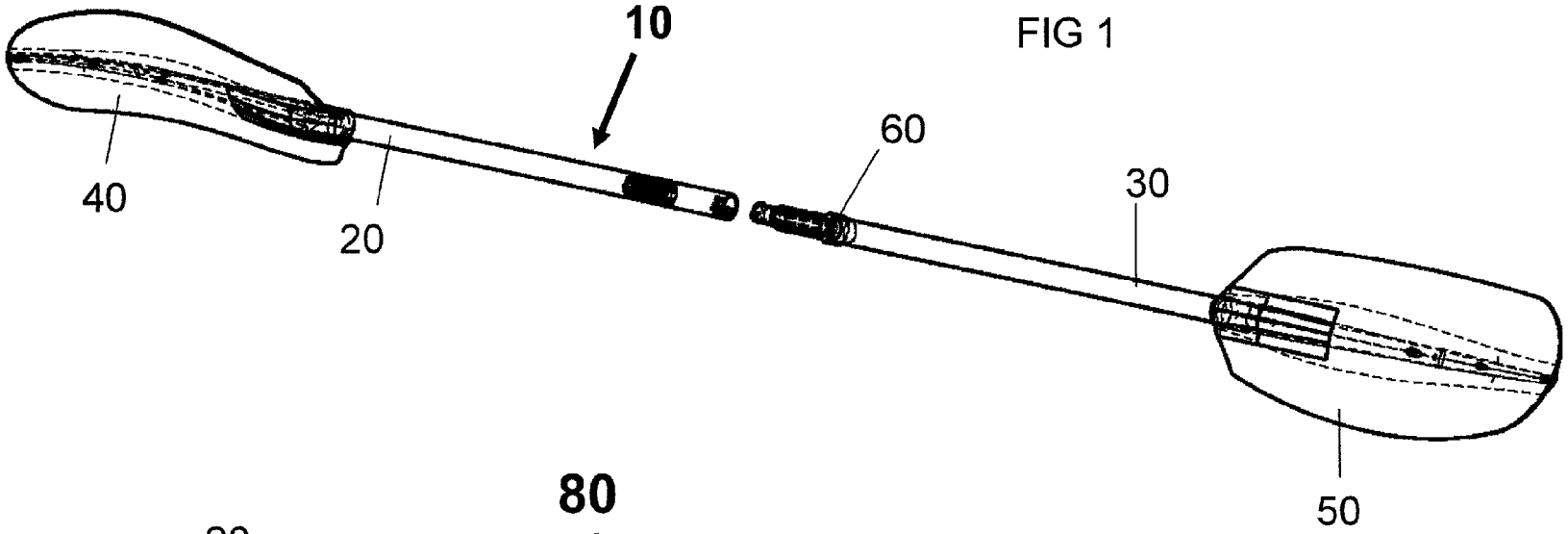
FIG. 1 is a perspective view of an embodiment of the paddle of the invention unassembled.

FIG. 1 shows a disassembled paddle 10 with a disassembled joint or joint mechanism of an embodiment of the present invention. The paddle comprises a first shaft 20 with first blade 40 at the second end of first shaft 20, and second shaft 30 with second blade 50 at the second end of second shaft 30. Second shaft 30 optionally has a ring 60 at first end of second shaft 30.

Figure 2:
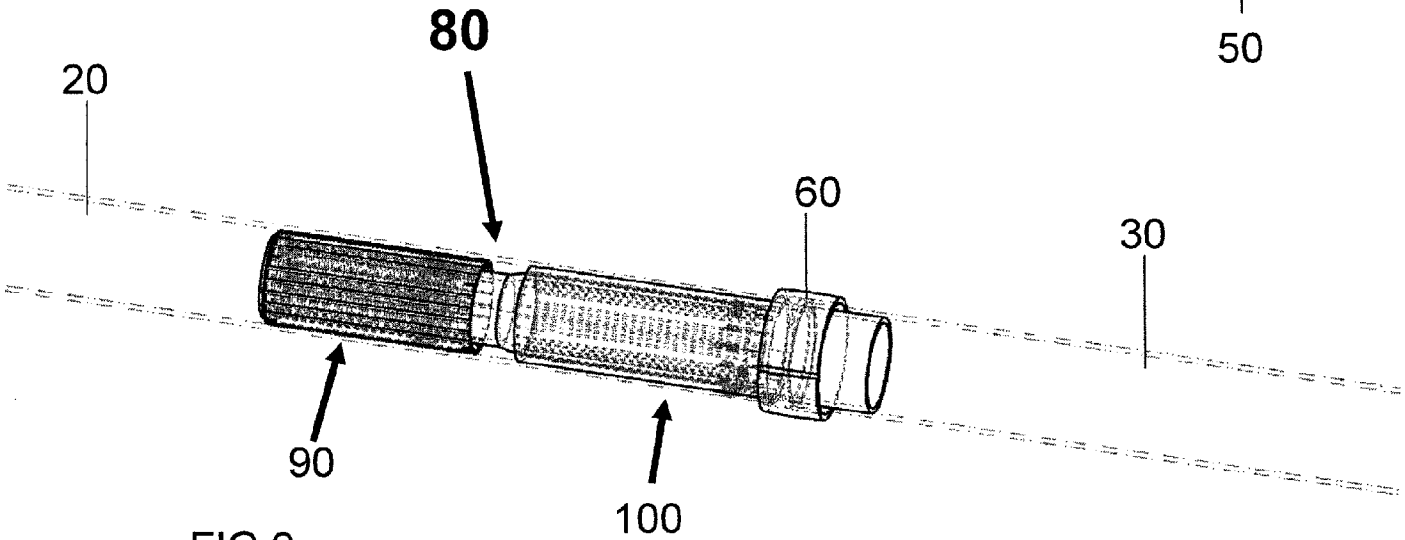
FIG. 2 is a perspective view of an assembled joint shown through the shafts of a paddle of an embodiment of the invention.

FIG. 2 shows an embodiment of the joint mechanism 80 of the adjustable paddle of the present invention, comprising female body 90 and male body 100. Female body 90 is recessed within first end of first shaft 20 and secured in place.

Male body projects from the first end of the second shaft. When the paddle 10 is assembled, male body 100 is positioned within the first end of first shaft 20 and ring 60 fits over the first end of first shaft 20. The joint may be located around the centre point of the paddle and adapted to enable the paddle to have good balance.

Figure 3:
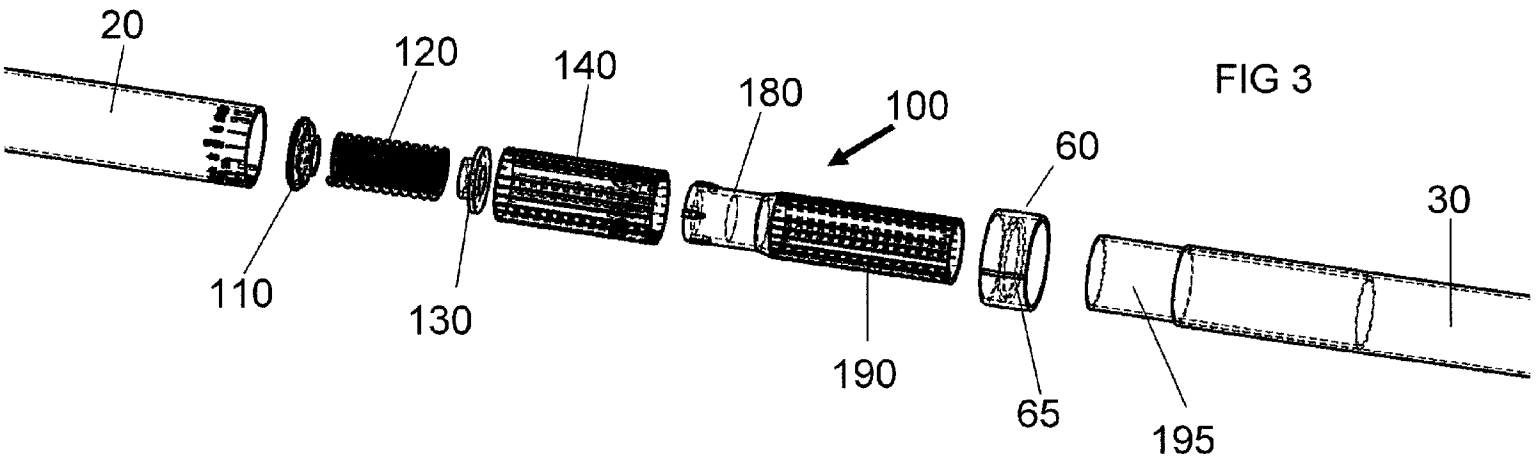
FIG. 3 is an exploded view of the components of a joint of an embodiment of the invention.

FIG. 3 shows a joint mechanism of an embodiment of the present invention in exploded view to show the various components. Female body 90 is comprised of a cylinder 140, and a spring mechanism 95 which is comprised of a first washer cap 110 and second washer cap 130 which bookend the spring 120 and fit into the first end of the cylinder 140. A toothed crown 150 is inside the second end of cylinder 140 wherein the teeth 160 abut the second washer 130, and between each tooth 160 is a pocket 165. The toothed crown 150 may be either molded into the interior of the cylinder 140 or fixedly secured into the cylinder 140. In an embodiment of the invention, the male body 100 is comprised of first section 180 with protuberances 200 and second section 190. The circumference of first section 180 is less than cylinder 140 and protuberances 200 have a first end which fits into receiving grooves 170 and a second end which fits into pockets 165, and the circumference of second section 190 is such that it fits within the first end of the first shaft 20, and in an embodiment of the invention additionally fits within a joining section 195. Alternatively, the male body 100 may be comprised of a single shaft of diameter to fit within female body 90 at its first end, and attached to second shaft by connecting means. In another alternative, male body 100 may be formed from second shaft and tapered at its first end to fit within the female body 90, and other variations of connection with the shaft are contemplated.

Figure 4:
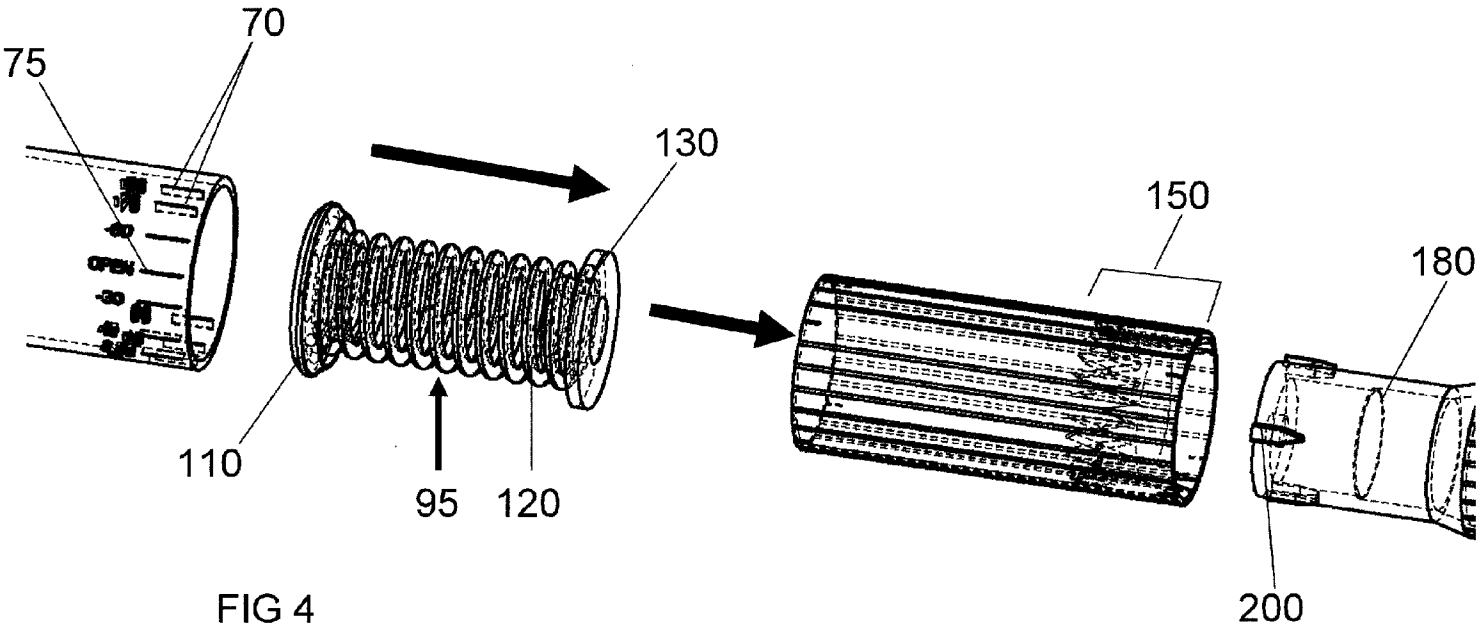
FIG. 4 is a partially exploded view of the female body of a joint of an embodiment of the invention with directional arrow indicating that the spring mechanism fits within the cylinder.
Figure 5:
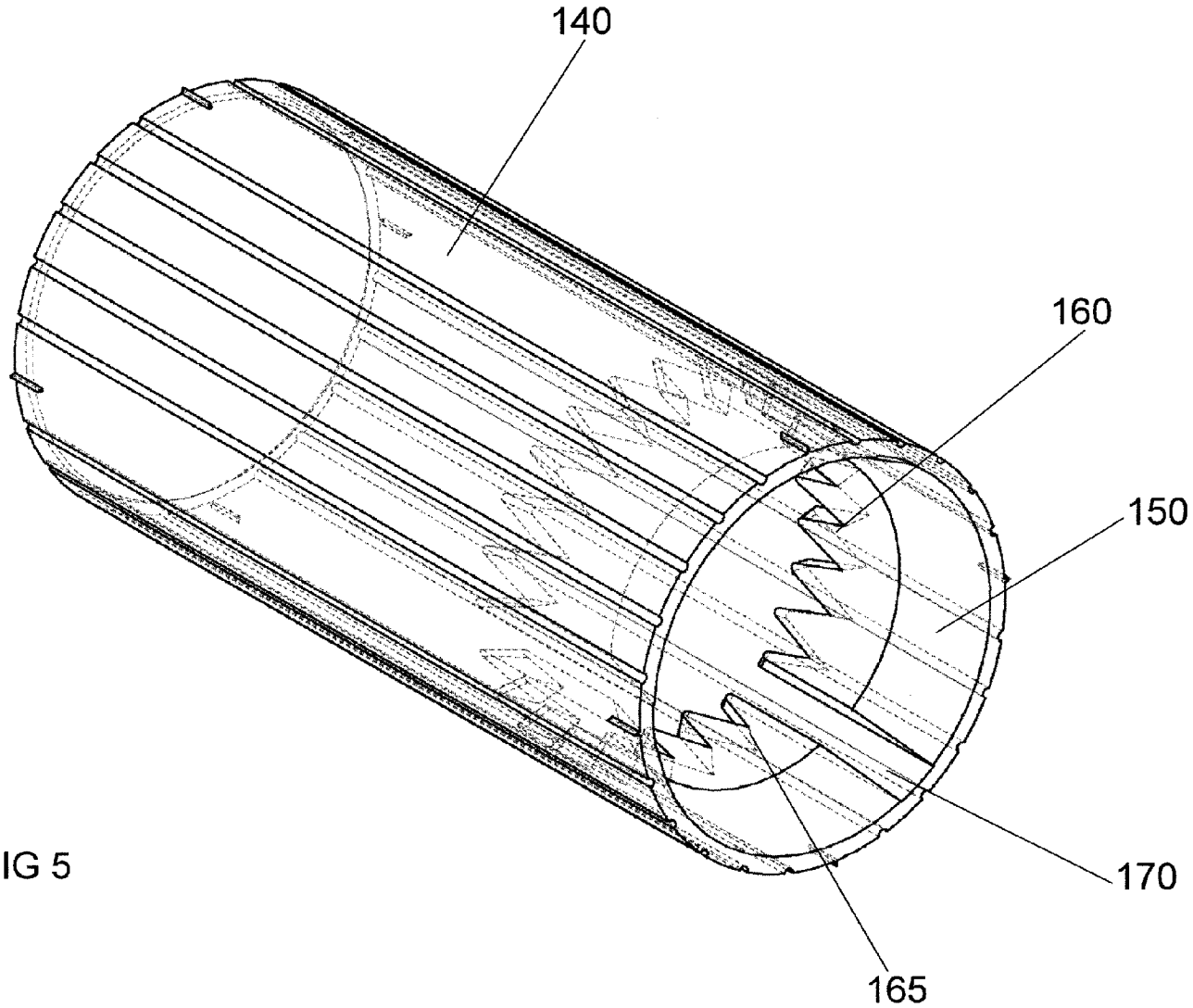
FIG. 5 is a perspective view of a cylinder of the female body of an embodiment of the invention showing through to show the crown.
Figure 6:
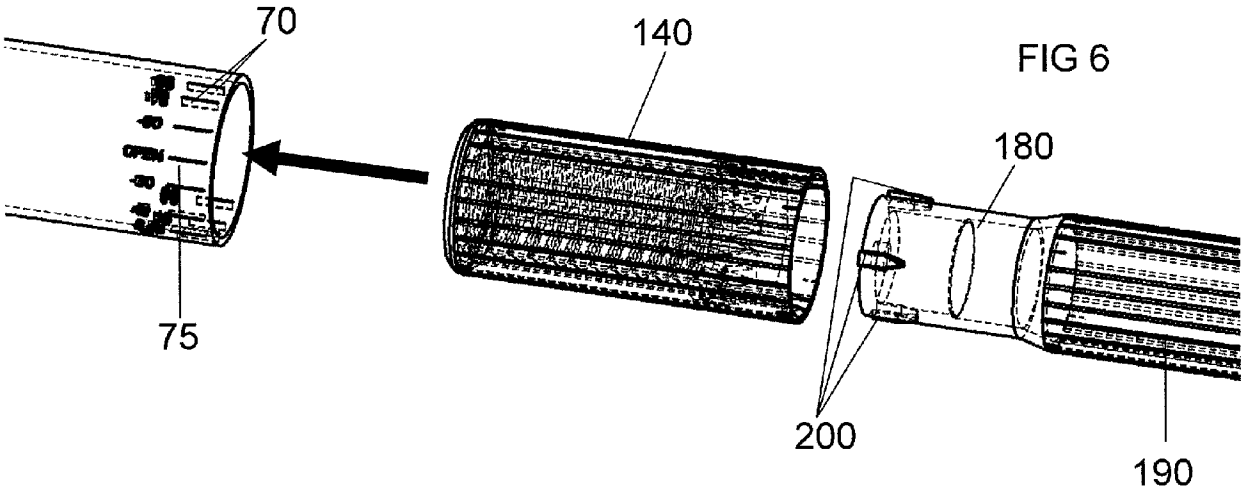
FIG. 6 is a partially exploded view of a disassembled joint with arrow indicating that the female body is inserted into the first shaft.

FIG. 4 shows the spring mechanism 95 comprised of the first washer cap 110 and second washer cap 130 which bookend the spring 120. FIG. 4 shows that in an embodiment of the present invention the spring mechanism is fitted into the first side of the cylinder 140. FIG. 5 shows the details of the cylinder 140 with receiving grooves 170, teeth 160 and pockets 165 in an embodiment of the present invention. FIG. 6 shows a female body 90 assembled with the spring mechanism 95 and cylinder 140. FIG. 6 shows that a female body 90 is inserted into the first shaft 20, and in an embodiment of the invention it is recessed into first shaft 20.

Figure 7:
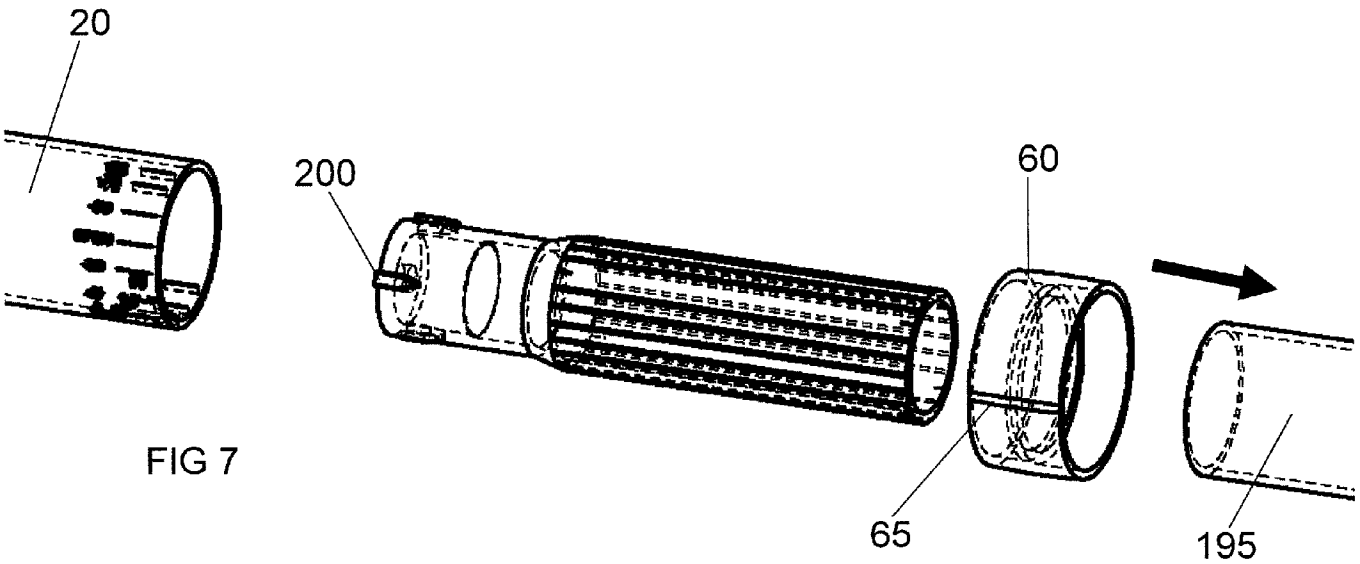
FIG. 7 is a partially exploded view of a disassembled joint with arrow indicating the direction of the ring when assembled and the direction that the male body is inserted into the joining section.

FIG. 7 shows an embodiment of the present invention wherein the male body 100 is fitted into a joining section 195 when assembled. This figure also shows that the diameter of the ring 60 is greater than the male body 100 and joining section 195. FIG. 7 also shows that the ring 60 optionally includes open indicator line 65, and that first shaft 20 preferably has blade angle markings 70 at first end of first shaft 20 and open indicator line 75. The present invention functions without the ring 60, markings 70 and indicator lines 65 and 75, however, the ring 60 provides a finished look and barrier to debris and the markings 70 enable a user to easily find the desired angles of the blades to one another, and the open indicator lines 65 and 75 enable a user to easily assemble and disassemble the paddle 10 into two components for ease of transport and storage. However, it is understood that blade angles may be selected without the markings 70 and the paddle may be assembled and disassembled without the indicator lines 65 and 75.

Figure 8:
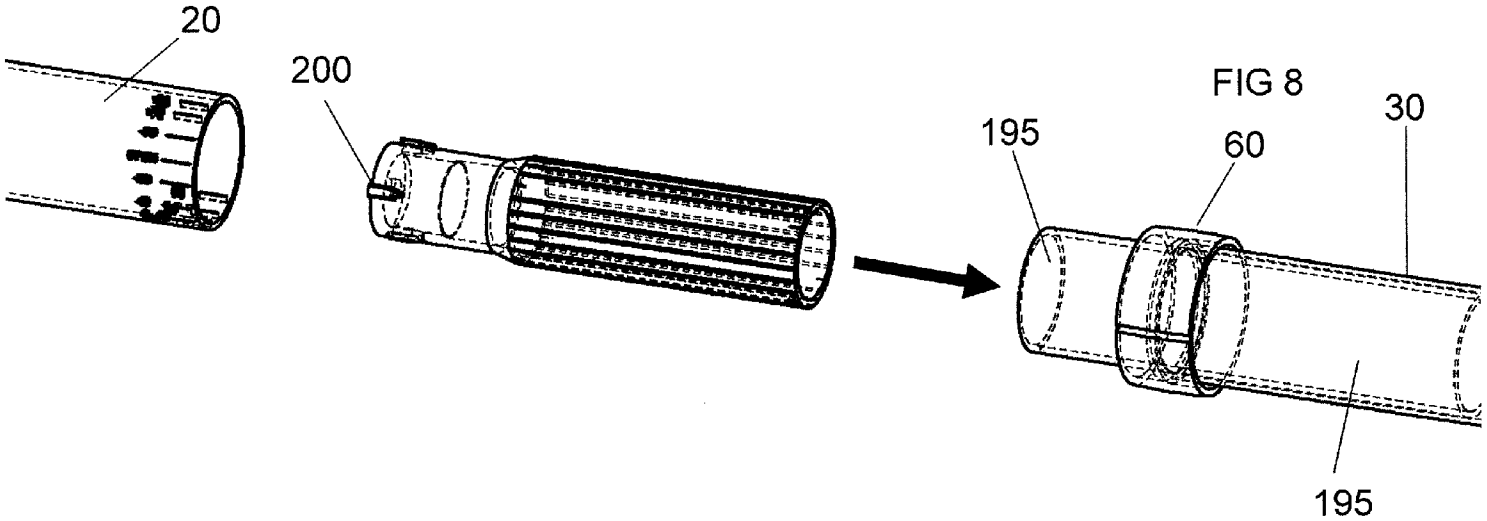
FIG. 8 is a partially exploded view of a disassembled joint with arrow indicating the direction that the male body is inserted into the joining section.
Figure 9:
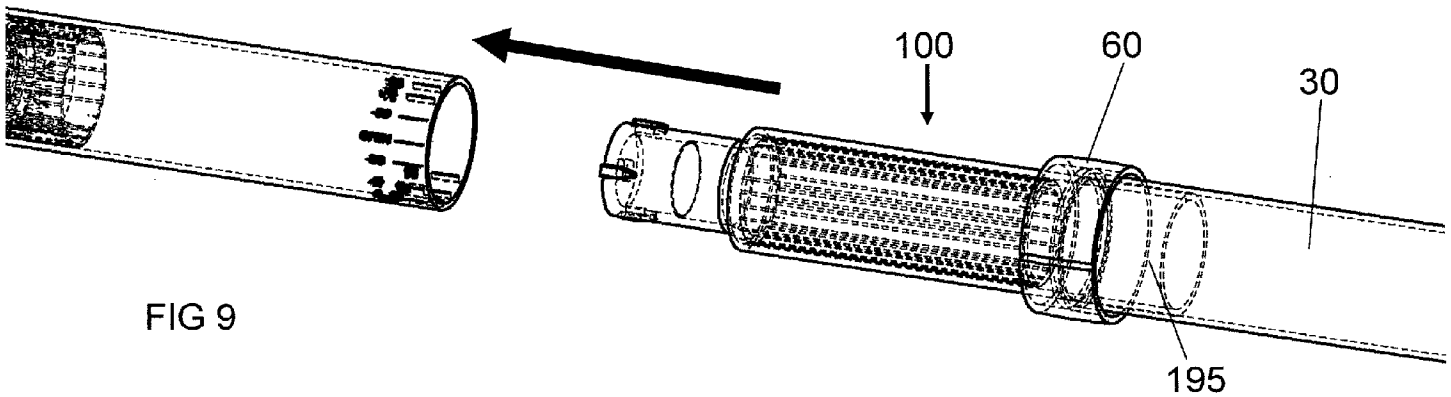
FIG. 9 is a perspective view of a disassembled joint with arrow indicating the direction of the male body to join with the female body in order to form an assembled joint.

FIG. 8 shows the direction that the male body 100 is inserted into the joining section 195, with the ring 60 in place on second shaft 30 and FIG. 9 shows the male body 100 in place within second shaft 30. FIG. 9 is of the disassembled joint and shows that the two shafts are capable of connecting by pushing them together.

Figure 10:
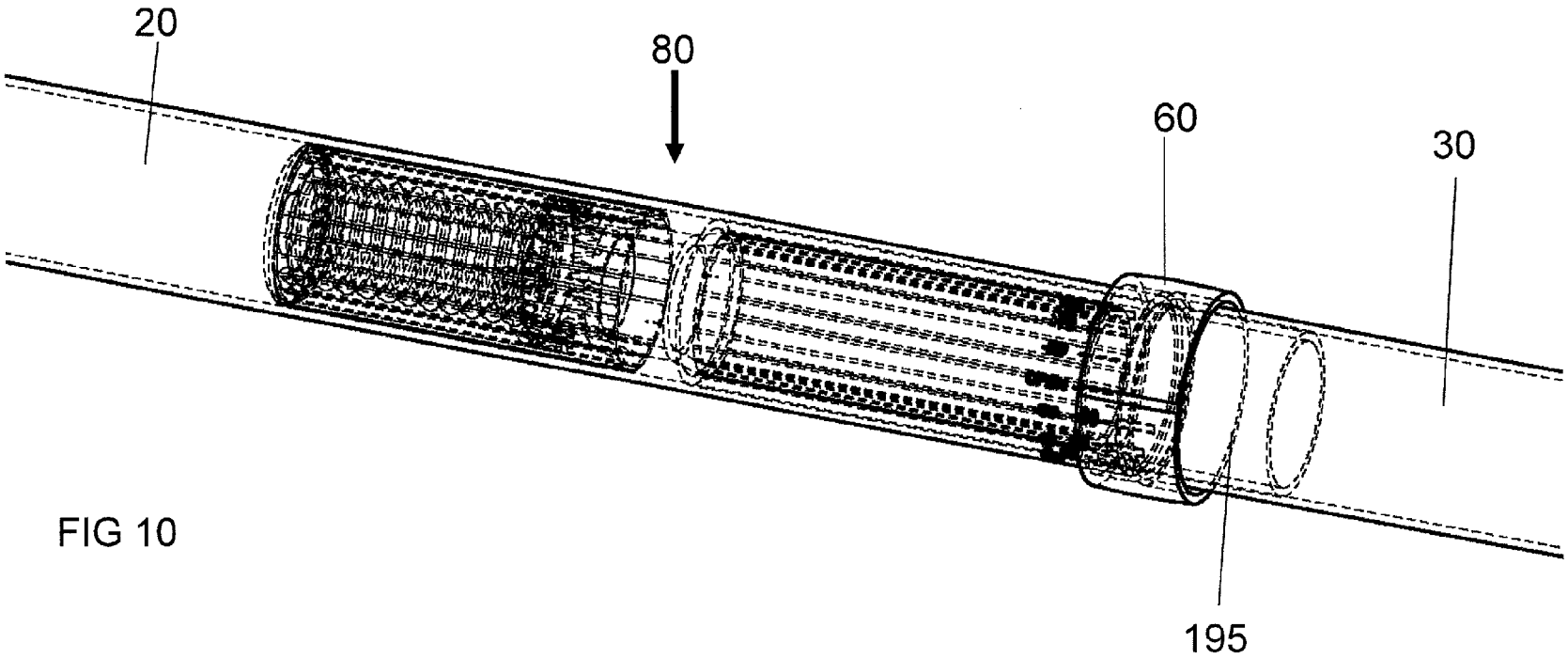
FIG. 10 is a perspective view of a joint of an embodiment of the present invention showing the location of the male body and female body when assembled.

FIG. 10 shows the joint 80 when male body 100 is inserted into the first end of first shaft 20 such that open indicator lines 65 and 75 align.

Figure 12A:
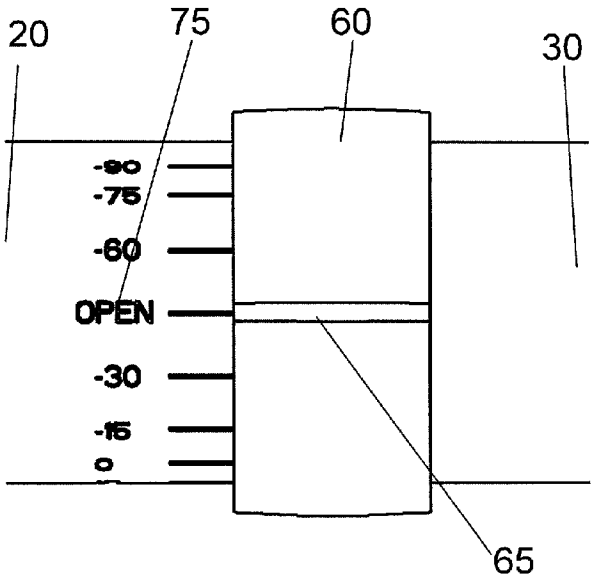
FIG. 12*a* is a side view of an alignment of the two shafts of an embodiment of the present invention in an open position.

To assemble the two sections together, the protuberances 200 of the male body 100 are aligned with the receiving grooves 170 of the female body 90 and the second shaft is pushed into the second shaft. This is referred to as the open position since this position also allows the two sections to also be separated and is show in FIG. 12*a*. The location of the protuberances 200 and receiving grooves 170 in open position can be marked on the first and second shafts for ease of assembly and disassembly.

Figure 12B:
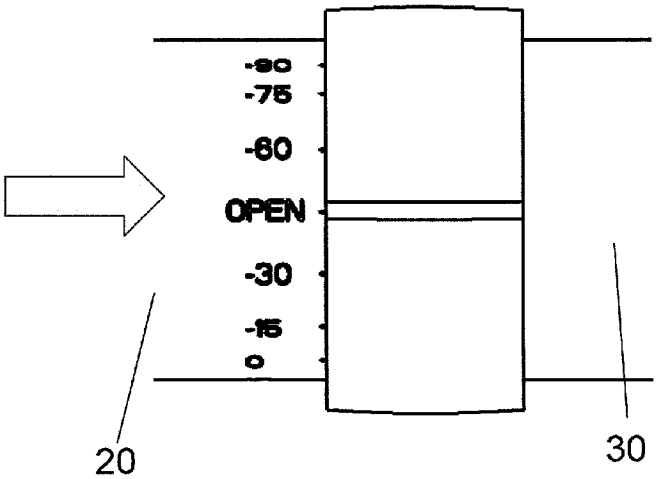
FIG. 12*b* is a side view of the shafts shown in FIG. 12*a* indicating that the shafts are pushed together.
Figure 11:
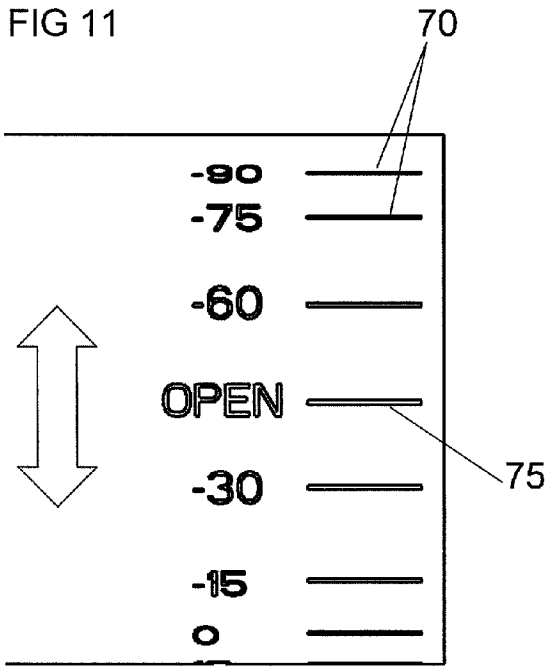
FIG. 11 is a side view of markings on a shaft of a paddle of an embodiment of the present invention.
Figure 12C:
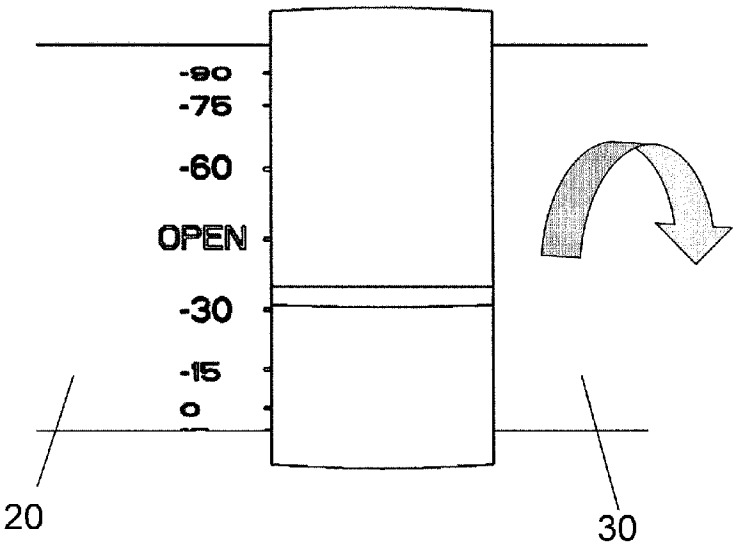
FIG. 12*c* is a side view of the shafts shown in FIG. 12*b* indicating that the shafts have been rotated counter to one another.
Figure 12D:
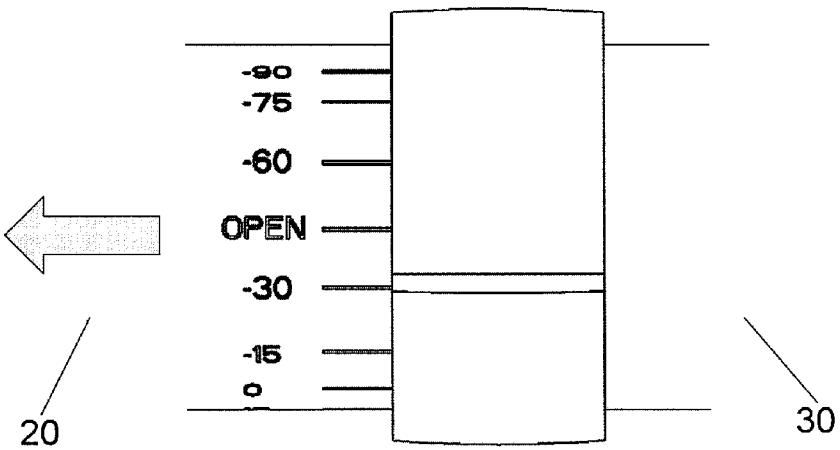
FIG. 12*d* is a side view of the shafts shown in FIG. 12*d* indicating that the pressure pushing the shafts together has been released.

FIG. 11 show the first shaft 20 with its markings and that it can be rotated in the direction of the arrow. FIG. 12*b* shows that to engage the two sections, in open position the male body is pushed against the spring mechanism 95 causing it to depress, and FIG. 12*c* shows that the male body is rotated and FIG. 12*d* shows that the pressure inward is released to engage the protuberances 200 with the pockets 165 between the teeth 160.

It will be understood that the female body 90 and male body 100 are pushed together and rotated but that the female body 90 may be pushed against the male body 100 or vice versa or both, and likewise that either the male body 100 or female body 90 may be rotated or both.

When the paddle is assembled, the method of adjusting the blade angle, which refers to the variation of the angle of first blade in relation to the second blade, is each time made by pushing the male body 100 into the female body 90, rotating the desired amount and releasing into the space between the teeth 160. The blades may be rotated at any angle relative to one another, only limited by the number of teeth and pockets present in the embodiment of the invention.

In an embodiment of the invention shown in the figures there are three protuberances 200 on the first section of the male body 200. The spacing of the teeth 160 in the female body 90 determines the blade angles and in an embodiment of the invention there are seven pockets 165 between each of the receiving grooves 170 which correspond to approximately a fifteen degree changes in angle between the blades. It is understood that variations may be made to the number of protuberances and teeth as desired. In an embodiment of the invention the open configuration which allows the user to disassemble the paddle into the two parts, is found at a minus thirty degree angle. Again the selection of the angles and open configuration may be varied as part of this invention. The selection of three protuberances enables stability and spread of forces generating by a user of the paddle, as well as providing a multiplicity of available blade angles. The more protuberances limit the number of teeth and thereby the number of angles available. Less protuberances than three decrease the reliability of the paddle to resist forces generated by a user of the paddle.

Given that the highest loading on a paddle occurs in the middle when in use by a paddler, an embodiment of the invention is that the joint mechanism is offset so that the highest of the bending forces is not centered on the joint. The balance and adjustment of the highest load is managed by the placement of the male body and female body and the joining section may be used to assist this placement.

As known by those in the art, paddle shafts may be comprised of a variety of materials and presently paddle shafts are being made from carbon fiber composites, glass fiber composites and aluminum.

The components of the joint mechanism of the present invention may be made from a variety of materials although most desirable of materials would be those that can withstand forces and resist water absorption or water damage. The components of the joint mechanism, with the exception of the spring which may be stainless steel, may be made of polyamide and in particular polyphthalamide. The first washer cap 110 may have an angled faces to form a sheer joint with the end of the cylinder 140 and then ultrasonically welded. The second washer cap 130 may be captive as a result of being affixed on the spring and wedged up to the toothed crown. The first section of the male body may be further comprised of a cap on which the protuberances are molded that is ultrasonically welded to the shaft of the first section. The joining section may be composed of carbon composite and adhered to both the second shaft 30 and the second section 190 with epoxy in that order or reverse order or at the same time. The female body 90 may also be adhered to the first shaft 20 with epoxy.

In an embodiment of the present invention, the male body 100 may be fastened to the second shaft 30 in any manner and in an embodiment of the invention as shown in FIG. 3, a joining section 195 with slightly less diameter than shaft 30 is placed within it to additionally offset the bending forces that will be exerted on the paddle in use.

The joint mechanism of this invention allows for considerable force to be applied by a user of the paddle without breakage or slippage of the set angle of the blades. When the blade angle is adjusted through the push and release movement any debris is able to fall away from the joint and debris can also be cleared when the paddle is disassembled.

It will be understood by those in the art that modifications of other components of the paddle are contemplated in this invention relating to joint mechanism 80, for example this invention could be used with a paddle with removable or fixed blades or with a paddle with variations to the shafts, such as being hollow in full or part, or with grips or other comfort devices.

This joint mechanism is described in a paddle however it can be utilized in any application in which two shafts are desired to easily be joined together and particularly in which shafts need to be easily coupled and uncoupled.

From the above detailed description of the invention, the operation and construction of same should be apparent. While there are herein shown and described example embodiments of the invention, it is nevertheless understood that various changes may be made with respect thereto without departing from the principle and scope of the invention as measured by the following claims.

We claim:

1. A joint mechanism of a paddle capable of connecting a first shaft and a second shaft, said first shaft comprising a cylindrically shaped female body located substantially at one end of said first shaft and said second shaft comprising a male body located at one end of said second shaft, wherein the female body encloses a spring mechanism and plurality of teeth, which spring mechanism in relaxed position abuts the points of the teeth in between which are located two or more grooves, and the male body has a number of protuberances which correspond to and are capable of passing through and past said grooves, and whereby the two shafts are connectable by inserting the male body into the female body.

2. A joint mechanism capable of connecting a first shaft and a second shaft, said first shaft comprising a cylindrically shaped female body located substantially at one end of said first shaft and said second shaft comprising a male body located at one end of said second shaft, wherein the female body encloses a spring mechanism and plurality of teeth, which spring mechanism in relaxed position abuts the points of the teeth in between which are located two or more grooves, and the male body has a number of protuberances which correspond to and are capable of fitting within said grooves in an engaged position, and whereby the two shafts are connectable by inserting the male body into the female body, and wherein the application of lateral force of the male body against the female body when in the engaged position disengages the protuberances from the grooves and depresses the spring mechanism, and the further application of rotational force turns the male body counter to the female body.

3. A disassembled paddle comprised of a first shaft and a second shaft, said first shaft comprising a cylindrically shaped female body located substantially at one end of said first shaft and said second shaft comprising a male body located at one end of said second shaft, wherein the female body encloses a spring mechanism and plurality of teeth, which spring mechanism in relaxed position abuts the points of the teeth in between which are located two or more grooves, and the male body has a number of protuberances which correspond to and are capable of passing through and past said grooves, and whereby the two shafts are connectable by inserting the male body into the female body.

4. A paddle comprised of a first shaft and a second shaft, said first shaft comprising a cylindrically shaped female body located substantially at one end of said first shaft and said second shaft comprising a male body located at one end of said second shaft, wherein the female body encloses a spring mechanism and plurality of teeth, which spring mechanism in a relaxed position abuts the points of the teeth in between which are located two or more grooves, and the male body has a number of protuberances which correspond to and are capable of fitting within said grooves in an engaged position, and wherein the application of lateral force to the male body against the female body when in the engaged position disengages the protuberances from the grooves and depresses the spring mechanism, and the further application of rotational force turns the male body counter to the female body.

5. A disassembled paddle comprising:

a first shaft having a female end and a first shaft blade end;

a second shaft having a male end and a second shaft blade end;

a female body recessed within the female end;

a male body extending from the male end; and said female body comprising a substantially cylindrical body enclosing a spring mechanism, plurality of teeth and two or more grooves, which spring mechanism in relaxed position abuts the points of the teeth in between which are located the grooves, and said male body comprises a substantially cylindrical body with a number of protuberances which correspond to and are capable of passing through and past said grooves.

6. The paddle of claim 5, wherein the spring mechanism comprises a spring in between a first washer fixed to the female body and a second washer.

7. The paddle of claim 5, wherein the teeth are spaced evenly and the location of each of the teeth corresponds to a mark on the paddle.

8. The paddle of claim 6, wherein the ring is marked with a line to indicate alignment of the protuberances with the grooves and the first shaft is marked with a line to indicate alignment of the grooves with the protuberances.

9. The paddle of claim 7, wherein the teeth are spaced to correspond with fifteen degree variations in the orientation of the first blade with respect to the second blade.

10. The paddle of claim 5, wherein the first shaft further comprises a first blade at the first shaft blade end and the second shaft further comprises a second blade at the second shaft blade end.

11. The paddle of claim 10, wherein the number of protuberances is three.

12. A paddle comprising:

a first shaft having a female end and a first shaft blade end;

a second shaft having a male end and a second shaft blade end;

a female body recessed within the female end; a male body extending from the male end; and said female body comprising a substantially cylindrical body enclosing a spring mechanism, plurality of teeth and two or more grooves, which spring mechanism in relaxed position abuts the points of the teeth in between which are located the grooves, and said male body comprises a substantially cylindrical body with a number of protuberances which correspond to and are capable of passing through and past said grooves; and wherein the protuberances are positioned between the teeth.

13. The paddle of claim 12, wherein the first end of the second shaft includes a ring which extends to cover any gap between the second shaft and the first shaft.

14. A joint mechanism for connecting a first shaft and a second shaft, comprising: a female body located substantially at a female body end of the first shaft, wherein the female body is substantially cylindrical enclosing a biasing means, one or more grooves and a plurality of teeth; a male body located at a male body end of the second shaft, wherein the male body is substantially cylindrical having one or more protuberances capable of fitting within the one or more grooves of the female body, and removeably catching between each of the plurality of teeth in an engaged position; whereby the first shaft and the second shaft are capable of being moved rotationally relative to one another at finite angles during the simultaneous application of a pushing lateral force and a rotational force to a desired angle of the first and second shaft relative to one another.

* * * * *